US011727865B1

(12) United States Patent
Yang et al.

(10) Patent No.: US 11,727,865 B1
(45) Date of Patent: Aug. 15, 2023

(54) LIGHT-EMITTING DIODE DRIVER AND DISPLAY APPARATUS USING THE SAME

(71) Applicant: Audiowise Technology Inc., Hsinchu (TW)

(72) Inventors: Tsung-Han Yang, Hsinchu (TW); Chia-So Chuang, Hsinchu (TW); Pin-Hsuan Huang, Hsinchu (TW)

(73) Assignee: AIROHA TECHNOLOGY CORP., Hsinchu (TW)

( * ) Notice: Subject to any disclaimer, the term of this patent is extended or adjusted under 35 U.S.C. 154(b) by 0 days.

(21) Appl. No.: 17/828,473

(22) Filed: May 31, 2022

(51) Int. Cl.
*G09G 3/32* (2016.01)

(52) U.S. Cl.
CPC ..... *G09G 3/32* (2013.01); *G09G 2330/028* (2013.01)

(58) Field of Classification Search
CPC ..... G09G 3/32; G09G 2330/028
See application file for complete search history.

(56) References Cited

U.S. PATENT DOCUMENTS

2017/0098410 A1* 4/2017 Lee ..... G09G 3/28
2018/0293955 A1* 10/2018 Liu ..... H03K 19/0175
2018/0336816 A1* 11/2018 Shin ..... G09G 3/32
2019/0206357 A1* 7/2019 Ahn ..... G09G 3/3225
2020/0380904 A1* 12/2020 Yeh ..... G09G 3/3696
2021/0343231 A1* 11/2021 Gray ..... H04B 3/542
2021/0343232 A1* 11/2021 Ma ..... G09G 3/32
2021/0366391 A1* 11/2021 Wei ..... G09G 3/3208
2021/0366405 A1* 11/2021 Kim ..... G09G 3/3696

* cited by examiner

*Primary Examiner* — Andrew Sasinowski
(74) *Attorney, Agent, or Firm* — McClure, Qualey & Rodack, LLP

(57) ABSTRACT

A light-emitting diode driver and a display apparatus using the same are provided. The light-emitting diode driver includes a driving module and a plurality of current control modules. The driving module includes a plurality of bias circuits and a plurality of resistive devices, in which any two of the bias circuits are electrically coupled to each other through at least one of the resistive devices. The current control modules are respectively coupled to the bias circuits, and each of the current control modules includes a current control circuit and a slew-rate enhancement circuit. The current control circuit is configured to output a driving current. The slew-rate enhancement circuit is electrically coupled to the current control circuit, so as to output a complementary current.

19 Claims, 6 Drawing Sheets

LIGHT-EMITTING DIODE DRIVER AND DISPLAY APPARATUS USING THE SAME

FIELD OF THE DISCLOSURE

The present disclosure relates to a light-emitting diode driver and a display apparatus using the same, and more particularly to a light-emitting diode driver with a fast transient response and a display apparatus using the same.

BACKGROUND OF THE DISCLOSURE

With the recent development of display technology, for a display apparatus which displays full-color images through light-emitting diodes (hereinafter referred to as "LED display apparatus"), a higher and higher color resolution is being required of the LED display apparatus. In each of pixels of the conventional LED display apparatus, the light-emitting diodes for respectively generating different color light sources are used to generate different colors. By adjusting a current value of an output current applied to each of the light-emitting diodes, the color of each pixel can be adjusted.

However, in a conventional driving circuit of the light-emitting diodes, the output current actually applied to the light-emitting diode may be less than a preset current value due to a parasitic capacitance in the conventional driving circuit. As such, a performance of the LED display apparatus in color accuracy will not be as good as what is normally expected. That is to say, the color resolution of the LED display apparatus is restricted by a transient response time of the conventional driving circuit, and is difficult to be further improved.

SUMMARY OF THE DISCLOSURE

In response to the above-referenced technical inadequacies, the present disclosure provides a light-emitting diode driver and a display apparatus using the same. The light-emitting diode driver has a faster transient response, so that color accuracy and a color resolution of the display apparatus can be improved without significantly increasing a standby current or static power consumption.

In one aspect, the present disclosure provides a light-emitting diode driver. The light-emitting diode driver includes a driving module and a plurality of current control modules. The driving module includes a plurality of bias circuits and a plurality of resistive devices, in which any two of the bias circuits are electrically coupled to each other through at least one of the resistive devices. The current control modules are respectively coupled to the bias circuits, and each of the current control modules includes a current control circuit and a slew-rate enhancement circuit. The current control circuit is configured to output a driving current. The slew-rate enhancement circuit is electrically coupled to the current control circuit to output a complementary current.

In certain embodiments, the current control circuit includes a plurality of transistors, and gate terminals of the transistors are jointly coupled to the slew-rate enhancement circuit.

In certain embodiments, the current control circuit includes at least one transistor, the slew-rate enhancement circuit includes a slew-rate enhancement transistor having a control gate terminal, a first terminal, and a second terminal, and a gate terminal of the at least one transistor and the first terminal of the slew-rate enhancement transistor are jointly coupled to a control node.

In certain embodiments, the slew-rate enhancement circuit further includes a voltage setting circuit that is coupled to the control gate terminal of the slew-rate enhancement transistor, so that a preset bias is applied to the control gate terminal of the slew-rate enhancement transistor.

In certain embodiments, the voltage setting circuit includes a first transistor and a second transistor, a first source terminal of the first transistor is electrically coupled to a second drain terminal of the second transistor, and a first drain terminal of the first transistor and the control gate terminal of the slew-rate enhancement transistor are jointly coupled to a current source.

In certain embodiments, the second terminal of the slew-rate enhancement transistor is coupled to a power supply terminal.

In certain embodiments, each of the bias circuits includes an output node, and each of the resistive devices is connected between the two output nodes of any two of the bias circuits.

In certain embodiments, the current control circuit includes at least one transistor, and a gate terminal of the at least one transistor is coupled to a control node. Each of the current control modules includes a first switch device that is connected between the control node and the output node.

In certain embodiments, the driving module further includes a reference voltage circuit electrically coupled to each of the bias circuits.

In certain embodiments, one of the resistive devices is coupled in series between every two of the bias circuits in a series manner, so as to form a resistive bias network.

In certain embodiments, a quantity of the resistive devices is equal to or larger than a quantity of the bias circuits.

In certain embodiments, a ratio of a quantity of the bias circuits to a quantity of the current control modules is greater than 0.5.

In another aspect, the present disclosure provides a display apparatus. The display apparatus includes a pixel array and the light-emitting diode driver as mentioned above. The pixel array includes a plurality of pixels, and each of the pixels includes a plurality of light-emitting diodes for respectively generating different color light beams, so as to output a mixed light beam. The current control modules are respectively electrically connected to the light-emitting diodes so as to control a color of the mixed light beam that is emitted from each of the pixels.

In certain embodiments, in each of pixels, the light-emitting diodes include a red light-emitting diode, a blue light-emitting diode, and a green light-emitting diode.

Therefore, in the light-emitting diode driver and the display apparatus using the same provided by the present disclosure, by virtue of any two of the bias circuits being electrically coupled to each other through at least one of the resistive devices, and the slew-rate enhancement circuit being electrically coupled to the current control circuit to output the complementary current, the light-emitting diode driver has a fast transient response, and the color accuracy and the color resolution of the display apparatus including the light-emitting diode driver can be improved.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
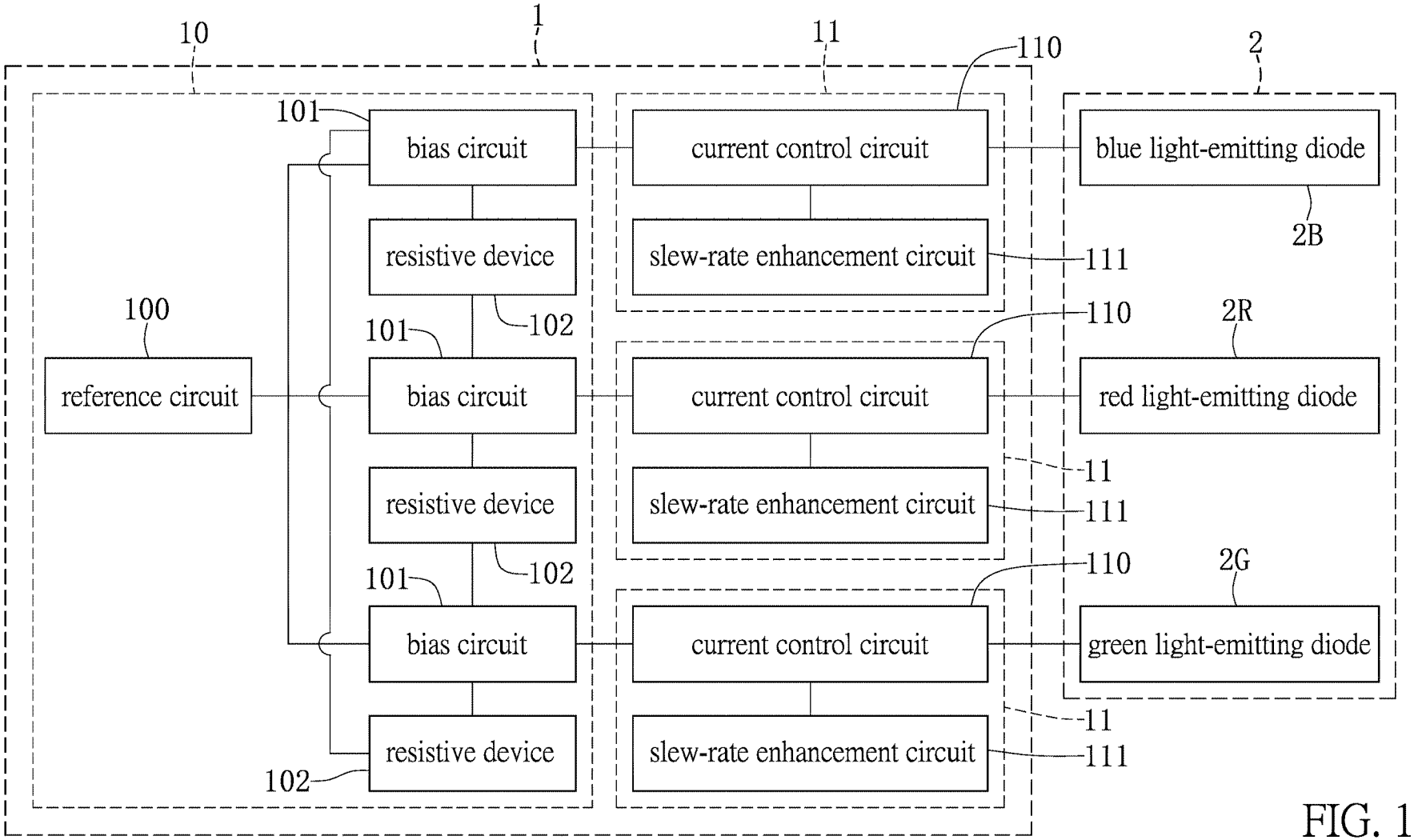
FIG. 1 is a functional block diagram of a light-emitting diode driver according to one embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Reference is made to FIG. 1, which is a functional block diagram of a light-emitting diode driver according to one embodiment of the present disclosure. A light-emitting diode driver 1 provided in the embodiment of the present disclosure can be implemented in a display apparatus, such as an LED display apparatus. Accordingly, a plurality of light-emitting diodes 2 can be used to respectively generate different color light beams, and jointly form one of pixels of the display apparatus. For example, the light-emitting diodes 2 can include a red light-emitting diode 2R, a blue light-emitting diode 2B, and a green light-emitting diode 2G, but the present disclosure is not limited thereto. The color light beams generated by the light-emitting diodes 2 are mixed to form a mixed light beam.

Specifically, the light-emitting diode driver 1 includes a driving module 10 and a plurality of current control modules 11. In the instant embodiment, the driving module 10 includes a reference voltage circuit 100, a plurality of bias circuits 101, and a plurality of resistive devices 102.

Figure 2:
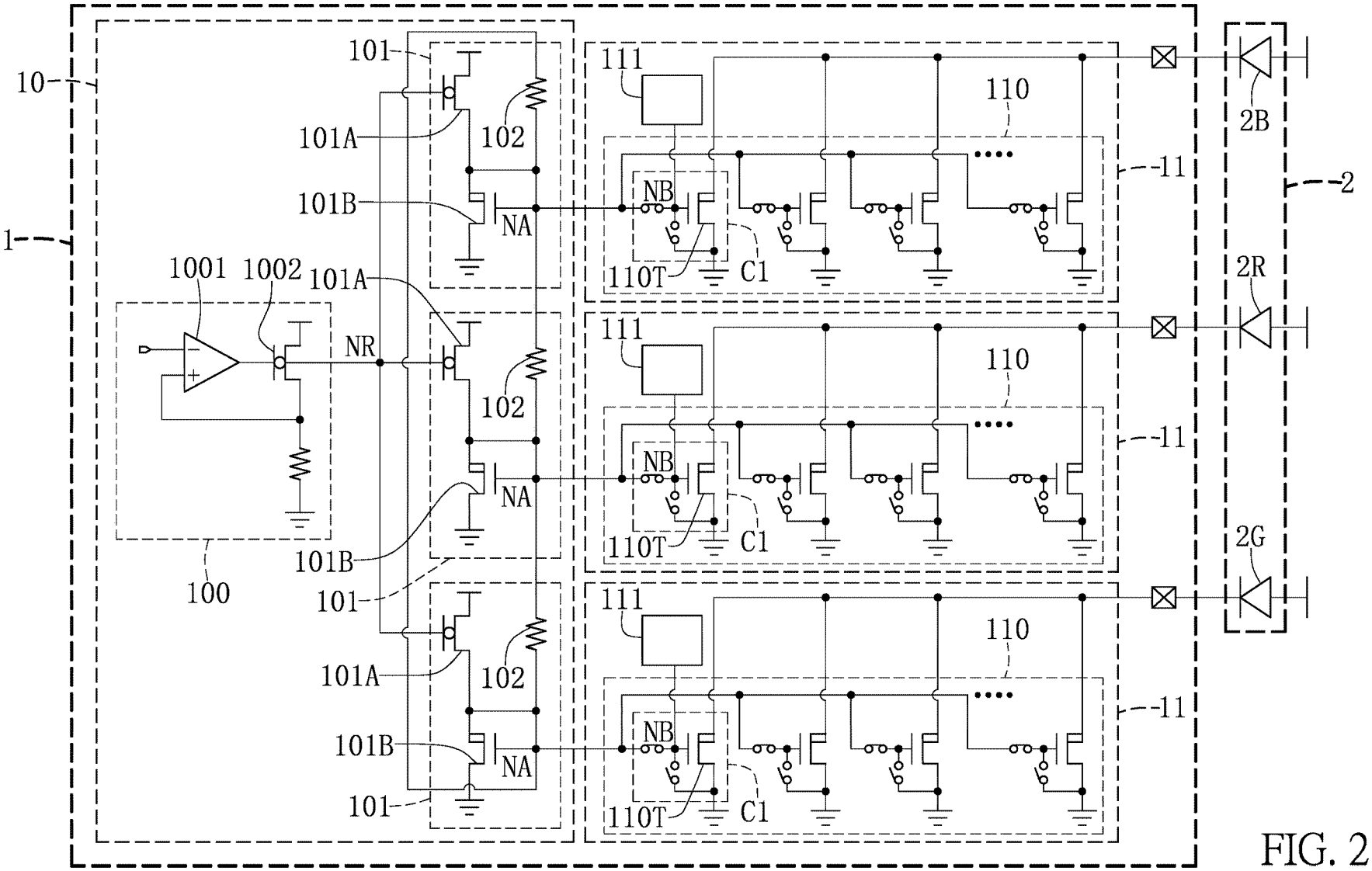
FIG. 2 is a schematic circuit diagram of the light-emitting diode driver according to one embodiment of the present disclosure.

Reference is made to FIG. 2, which is a schematic circuit diagram of the light-emitting diode driver according to one embodiment of the present disclosure. The reference voltage circuit 100 is configured to generate a reference voltage, and is electrically connected to the bias circuits 101. In one embodiment, the reference voltage circuit 100 can include a comparison circuit 1001 and a transistor device 1002. The comparison circuit 1001 can include a comparator or an operational amplifier. As shown in FIG. 2, an output terminal of the comparison circuit 1001 is electrically connected to a gate terminal of the transistor device 1002.

Furthermore, in the instant embodiment, input terminals of the bias circuits 101 and the output terminal of the reference voltage circuit 100 are jointly connected to a reference node NR. As shown in FIG. 2, in the instant embodiment, each of the bias circuits 101 includes two transistors 101A, 101B. In addition, a gate terminal of the transistor 101A serves as the input terminal of each bias circuit 101, and is electrically coupled to the reference node NR. A gate terminal and a drain terminal of the other transistor 101B have the same electrical potential, and the gate terminal of the transistor 101B serves as an output node NA of each bias circuit 101, but the present disclosure is not limited to the example provided herein. Each of the bias circuits 101 is electrically connected to one of the current control modules, so as to supply a bias current.

As shown in FIG. 1 and FIG. 2, the resistive devices 102 and the bias circuits 101 are connected to one another in a series manner, so as to form a resistive bias network. Specifically, any two of the bias circuits 101 are electrically coupled to each other through at least one of the resistive devices 102, but the present disclosure is not limited thereto. In another embodiment, there are two or more resistive devices 102 that are serially connected between every two of the bias circuits 101. Accordingly, a quantity of the resistive devices 102 is equal to or greater than a quantity of the bias circuits 101.

As shown in FIG. 2, each of the resistive devices 102 is connected between two output nodes NA of any two of the bias circuits 101. By connecting at least one of the resistive devices 102 between any two of the bias circuits 101 in a series manner, the bias current outputted by any one of the bias circuits 101 can be used to compensate the bias current outputted by another one of the bias circuits 101. The resistive devices 102 can include a resistor, a transistor, a diode, or any combination thereof. In the embodiment shown in FIG. 2, each of the resistive devices 2 is a resistor, but the present disclosure is not limited thereto. The operations and functions of the bias circuits 101 and the resistive devices 102 will be explained in greater detail below, and thus will not be repeated herein.

Reference is made to FIG. 1. The current control modules 11 are respectively and electrically connected to the light-emitting diodes 2, so as to drive the light-emitting diodes 2 to emit light. Furthermore, the current control modules 11 are respectively and electrically connected to the bias circuits 101. To be more specific, each of the bias circuits 101 outputs the bias current to a corresponding one of the current control modules 11, so as to control a driving current that is outputted by the corresponding one of the current control modules 11, and a brightness of a corresponding one of the light-emitting diodes 2.

In the instant embodiment, a quantity of the current control modules 11 is equal to a quantity of the light-emitting diodes 2. Furthermore, in the present disclosure, by increasing the quantity of the bias circuits 101, a transient response speed of the light-emitting diode driver 1 can be improved. As such, when multiple ones of the light-emitting diodes 2 need to be simultaneously turned on to generate the mixed light beam, the bias circuits 101 can individually output the bias currents, so that the current control modules 11 that are electrically connected thereto can be controlled to output driving currents at the same time. In the instant embodiment, the quantity of the bias circuits 101 is equal to the quantity of the current control modules 11, but the present disclosure is not limited to the example provided herein. For example, when the quantities of the bias circuits 101 and the current control modules 11 are greater than 2, and a ratio of the quantity of the bias circuits 101 to the quantity of the current control modules 11 is greater than 0.5, a transient response time of the light-emitting diode driver 1 can be reduced.

Referring to FIG. 2, in the instant embodiment, each one of the current control modules 11 includes a current control circuit 110 and a slew-rate enhancement circuit 111. The current control circuit 110 is configured to output the driving current, and can adjust a current value of the driving current according to practical implementations. In the instant embodiment, the current control circuit 110 includes one or more current control units C1 (multiple current control units C1 are exemplarily illustrated in FIG. 2).

Figure 3:
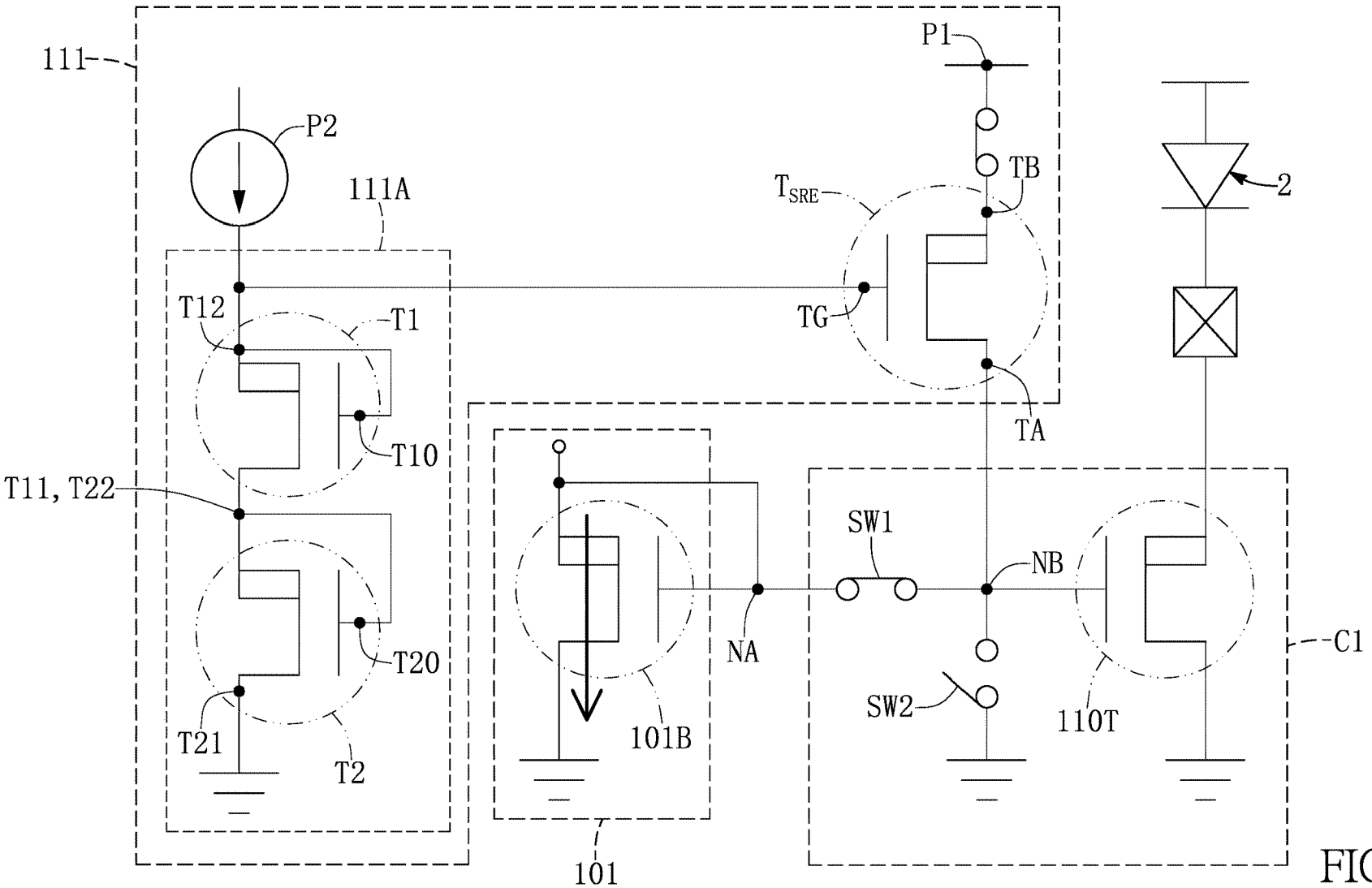
FIG. 3 is a partial schematic circuit diagram of a current control module according to one embodiment of the present disclosure.

Referring to FIG. 2 and FIG. 3, FIG. 3 is a partial schematic circuit diagram of a current control module according to one embodiment of the present disclosure. It should be noted that only one current control unit C1 is exemplarily illustrated in FIG. 3 for explaining a detailed electrical connection between the slew-rate enhancement circuit 111 and the current control unit C1, but the present disclosure is not limited to the example provided herein. Each of the current control units C1 includes a transistor 110T, a first switch device SW1, and a second switch device SW2, but the present disclosure is not limited thereto.

As shown in FIG. 3, in the instant embodiment, a gate terminal of the transistor 110T is electrically coupled to a control node NB. One of a source terminal and a drain terminal of the transistor 110T is grounded, and another one of the source terminal and the drain terminal is electrically connected to a corresponding one of the light-emitting diodes 2. The control node NB is electrically connected to the output node NA of the corresponding bias circuit 101. When a bias applied to the gate terminal of the transistor 110T is greater than a predetermined value, the transistor 110T is turned on, so that the driving current is outputted to the corresponding light-emitting diode 2.

The first switch device SW1 is connected between the control node NB and the output node NA, so as to control the transistor 110T to be turned on or off. Furthermore, the second switch device SW2 is connected between the control node NB and a ground terminal. When the first switch device SW1 is in a closed state, and the second switch device SW2 is in an open state, the bias circuit 101 can output the bias current to turn on the transistor 110T. When the first switch device SW1 is in an open state, and the second switch device SW2 is in a closed state, the transistor 110T is turned off.

It is worth mentioning that in one embodiment (as shown in FIG. 2), for each current control circuit 110, the gate terminals of the transistors 110T of all the current control units C1 are jointly coupled to the control node NB, and the transistors 110T are electrically connected to each other in a parallel manner. Accordingly, by individually controlling the states of the first switch devices SW1 and the second switch devices SW2 of the current control units C1, the current value of the driving current that is outputted by each of the current control circuits 110 can be determined, thereby controlling the brightness of each of the light-emitting diodes 2. In one embodiment, one of control circuits, such as a pulse width modulation (PWM) circuit, can be used to control the states of the first switch devices SW1 and the second switch devices SW2, but the present disclosure is not limited to the example provided herein.

It should be noted that the larger the current value of the driving current that is required to be outputted by each of the current control circuits 110, the greater a quantity of the transistors 110T to be turned on. However, a parasitic capacitance in a gate of the transistor 110T results in an increase of the transient response time of the light-emitting diode driver 1. Specifically, the current value of the driving current that is outputted by each of the current control circuit 110 can hardly reach a preset current value during a limited turned-on period due to the parasitic capacitance in the gate of the transistor 110T. The greater the quantity of the transistors 110T to be turned on, the greater the effect of the parasitic capacitance on the transient response time.

As shown in FIG. 2, in the instant embodiment, by connecting any two of the bias circuits 101 in a series manner through the resistive devices 102, the bias currents outputted by the bias circuits 101 can compensate one another, thereby reducing the effect of the parasitic capacitance on the transient response time. For example, when only the red light-emitting diode 2R needs to be turned on, the bias currents that are outputted by two of the bias circuits 101 respectively and electrically connected to the green light-emitting diode 2G and the blue light-emitting diode 2B can be transmitted to the current control circuit 110 that is electrically connected to the red light-emitting diode 2R. In this way, the current value of the driving current for driving the red light-emitting diode 2R can be rapidly increased.

It is worth mentioning that by properly adjusting a resistance of each resistive device 102 connected between any two of the bias circuits 101, when one of the light-emitting diodes 2 (e.g. the red light-emitting diode 2R) is driven, insufficiency of the bias currents supplied to the current control circuits 110 that are electrically connected to other ones of the light-emitting diodes 2 (e.g. the blue light-emitting diode 2B and the green light-emitting diode 2G) can be avoided.

Moreover, in the instant embodiment, each of the current control modules 11 further includes the slew-rate enhancement circuit 111, so as to reduce the effect of the parasitic capacitance on a current increase rate of the driving current. Specifically, for each of the current control modules 11, the slew-rate enhancement circuit 111 is electrically coupled to the current control circuit 110, so as to output a complementary current.

Referring to FIG. 2, an output terminal of the slew-rate enhancement circuit 111 and the gate terminal of each of the transistors 110T are jointly coupled to the control node NB. As such, when the first switch device SW1 is switched to the closed state, the slew-rate enhancement circuit 111 outputs the complementary current to the gate terminal of the corresponding transistor 110T until a bias applied to the gate terminal of the corresponding transistor 110T reaches to a predetermined voltage value. It is worth mentioning that the gate terminals of the transistors 110T are jointly coupled to the slew-rate enhancement circuit 111. In this way, the negative effect on the transient response of the light-emitting diode driver 1 due to the parasitic capacitance of the transistors 110T can be attenuated.

Referring to FIG. 3, the slew-rate enhancement circuit 111 in the embodiment of the present disclosure includes a slew-rate enhancement transistor $T_{SRE}$ and a voltage setting circuit 111A, but the present disclosure is not limited thereto. In another embodiment, the slew-rate enhancement circuit 111 can include other elements to execute the same function and achieve the same result.

In the instant embodiment, the slew-rate enhancement transistor $T_{SRE}$ has a control gate terminal TG, a first terminal TA, and a second terminal TB. The first terminal TA can be a source terminal or a drain terminal of the slew-rate enhancement transistor $T_{SRE}$. Furthermore, the first terminal TA of the slew-rate enhancement transistor $T_{SRE}$ can serve as the output terminal of the slew-rate enhancement circuit 111, and the first terminal TA and the gate terminal(s) of the transistor(s) 110T are jointly coupled to the control node NB. In addition, the second terminal TB of the slew-rate enhancement transistor $T_{SRE}$ can be electrically coupled to a power supply terminal P1.

The voltage setting circuit 111A is coupled to the control gate terminal TG of the slew-rate enhancement transistor $T_{SRE}$, so as to apply a preset bias to the control gate terminal of the slew-rate enhancement transistor $T_{SRE}$. As shown in FIG. 3, the voltage setting circuit 111A includes a first transistor T1 and a second transistor T2.

The first transistor T1 has a first gate terminal T10, a first source terminal T11, and a first drain terminal T12. The second transistor T2 has a second gate terminal T20, a second source terminal T21, and a second drain terminal T22. As shown in FIG. 3, the first source terminal T11 of the first transistor T1 is electrically coupled to the second drain terminal T22 of the second transistor T2. Furthermore, the first drain terminal T12 of the first transistor T1 and the control gate terminal TG of the slew-rate enhancement transistor $T_{SRE}$ are jointly coupled to a current source P2.

The preset bias is continuously applied to the control gate terminal TG of the slew-rate enhancement transistor $T_{SRE}$. When the first switch device SW1 is switched to the closed state, an initial bias between the control gate terminal TG and the first terminal TA is greater than a threshold voltage of the slew-rate enhancement transistor $T_{SRE}$. Accordingly, the slew-rate enhancement transistor $T_{SRE}$ is turned on, and the complementary current is outputted to the control node NB. An electric potential at the control node NB (or the first terminal TA) gradually increases. When the bias between the control gate terminal TG and the first terminal TA is less than the threshold voltage of the slew-rate enhancement transistor $T_{SRE}$, the slew-rate enhancement transistor $T_{SRE}$ is turned off, and no complementary current is provided.

Accordingly, the preset bias is assumed to be Vg, a bias applied to the first terminal TA (or the control node NB) is assumed to be Vx, and the threshold voltage of the slew-rate enhancement transistor $T_{SRE}$ is assumed to be Vth. When the present bias Vg, the bias Vx applied to the first terminal TA (or the control node NB), and the threshold voltage Vth satisfy the following relationship: Vth>(Vg−Vx), the slew-rate enhancement transistor $T_{SRE}$ is turned off, and the complementary current is not supplied to the first terminal TA.

For each of the current control modules 11, the bias applied to the first terminal TA (or the control node NB) can be rapidly increased due to the bias current outputted by each of the bias circuits 101 and the complementary current outputted by the slew-rate enhancement transistor $T_{SRE}$, thereby improving the current increase rate of the driving current that is outputted to the corresponding light-emitting diode 2.

Figure 4:
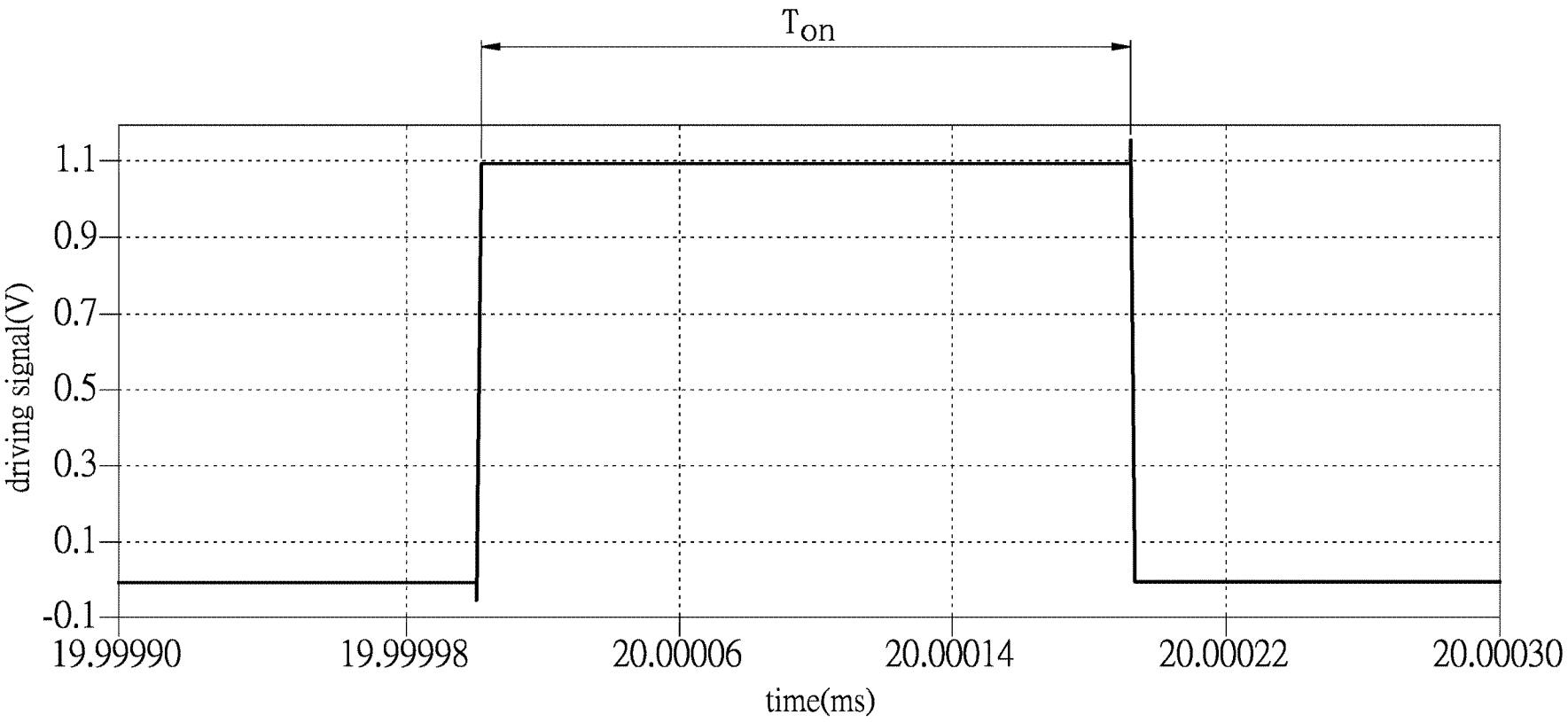
FIG. 4 is a schematic diagram showing a waveform of a driving signal according to one embodiment of the present disclosure.
Figure 5:
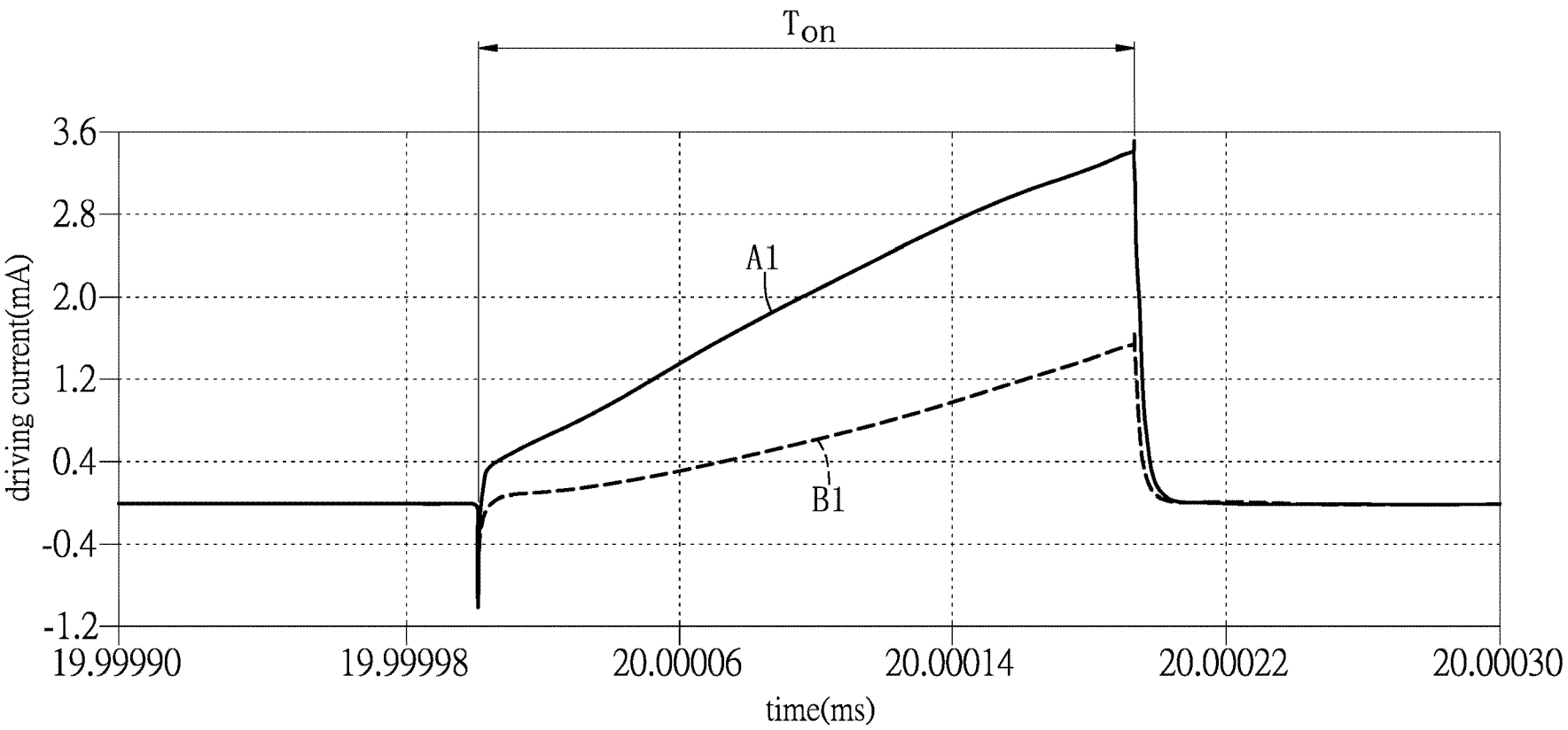
FIG. 5 is a schematic diagram showing current waveforms of a comparative example and one embodiment of the present disclosure.

Reference is made to FIG. 4 and FIG. 5, in which FIG. 4 is a schematic diagram showing a waveform of a driving signal according to one embodiment of the present disclosure, and FIG. 5 is a schematic diagram showing current waveforms of a comparative example and one embodiment of the present disclosure. As shown in FIG. 4, one of duty cycles of a driving signal is exemplified for illustrative purposes. During a turned-on period $T_{on}$, the first switch device SW1 is in a closed state, and the second switch device SW2 is in an open state.

As shown in FIG. 5, a curve A1 represents a current waveform of the light-emitting diode driver in one of the duty cycles of the driving signal according to the embodiment of the present disclosure. Furthermore, a curve B1 represents a current waveform of a driver of a comparative example in one of the duty cycles of the driving signal, and the driver of the comparative example does not include any slew-rate enhancement circuit.

As shown in FIG. 5, during the turned-on period $T_{on}$, a ramp-up slope of the curve A1 is greater than a ramp-up slope of the curve B1. That is to say, compared to the comparative example, during the turned-on period $T_{on}$ of the driving signal, the current increase rate of the driving current outputted by the light-emitting diode driver 1 in the embodiment of the present disclosure is larger, so that the driving current can be increased to have a larger current value. In this way, the transient response time of the light-emitting diode driver 1 in the embodiment of the present disclosure can be improved.

Figure 6:
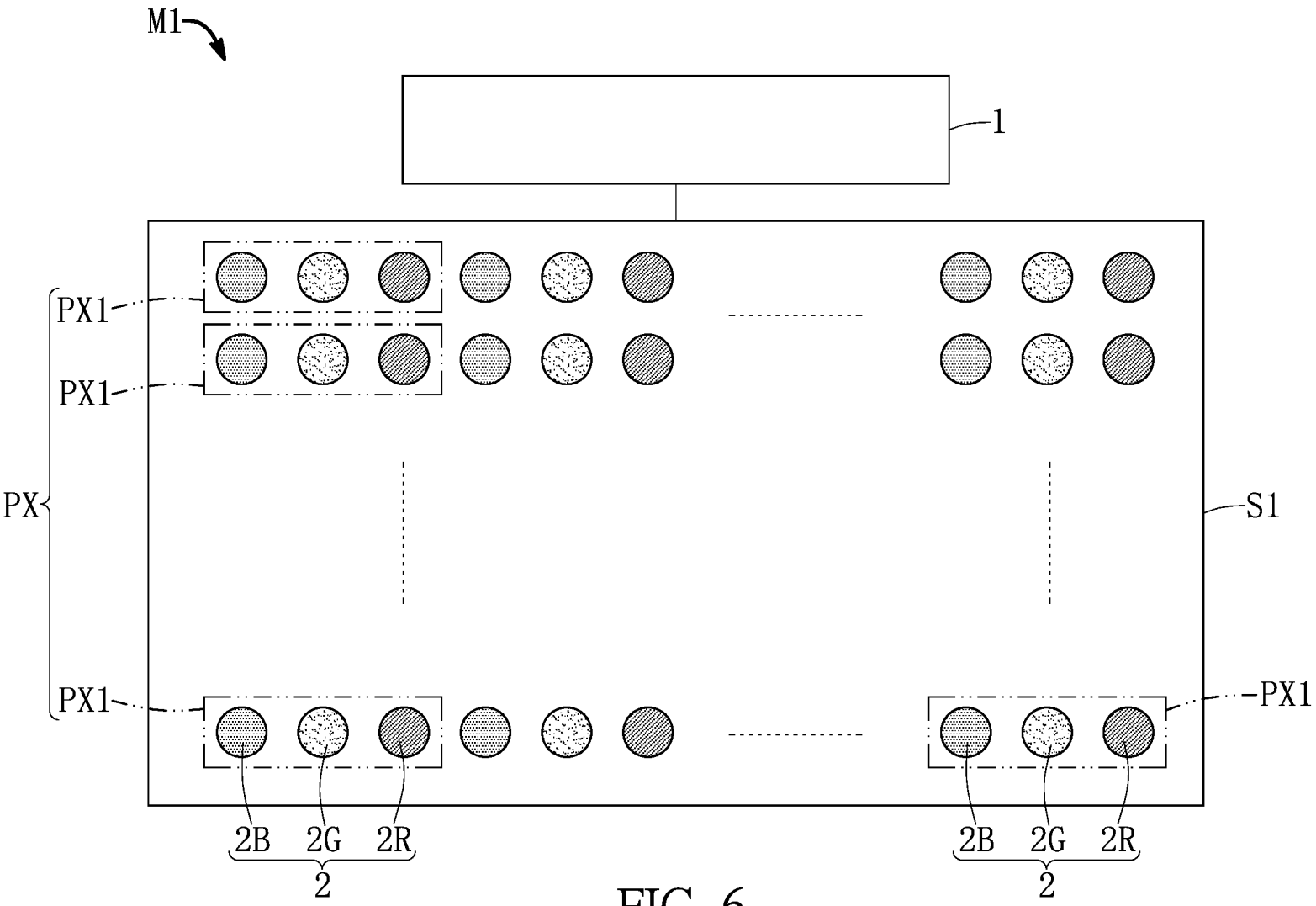
FIG. 6 is a schematic view of a display apparatus according to one embodiment of the present disclosure.

The light-emitting diode driver 1 in the embodiment of the present disclosure can be implemented in a light-emitting diode display apparatus (hereinafter referred to as "LED display apparatus"), or a backlight module of a liquid crystal display apparatus, but the present disclosure is not limited to the examples provided herein. Reference is made to FIG. 6, which is a schematic view of a display apparatus according to one embodiment of the present disclosure. In the instant embodiment, a display apparatus M1 is an LED display apparatus. The display apparatus M1 includes a pixel array PX and the light-emitting diode driver 1.

The pixel array PX can be disposed on a substrate S1 and include a plurality of pixels PX1. Each of the pixels PX1 can be formed by arranging the light-emitting diodes 2 that are respectively used to generate different color light beams, so that each of the pixels PX1 can output a mixed light beam. For example, the light-emitting diodes 2 can include the red light-emitting diode 2R, the blue light-emitting diode 2B, and the green light-emitting diode 2G, but the present disclosure is not limited thereto. By adjusting the brightness of each of the light-emitting diodes 2, a color of the mixed light beam (which is emitted from each pixel PX1) can be varied.

The elements of the light-emitting diode driver 1 are shown in FIG. 1 and FIG. 2, and will not be reiterated. The light-emitting diode driver 1 can be configured to drive each of the light-emitting diodes 2 in each pixel PX1 of the display apparatus M1. Since the brightness of each of the light-emitting diodes 2 is directly proportional to a driving current applied thereto, the driving current applied to each of the light-emitting diodes 2 can be adjusted by the light-emitting diode driver 1, so as to control the color of the mixed light beam. The faster the transient response of the light-emitting diode driver 1, the higher a color resolution of the display apparatus M1.

Referring to FIG. 6, which is to be read in conjunction with FIG. 1, the current control modules 11 of the light-emitting diode driver 1 can be respectively and electrically connected to the light-emitting diodes 2 in each pixel PX1. As mentioned previously, in the light-emitting diode driver 1 of the embodiment of the present disclosure, by using the resistive bias network formed by the bias circuits 101 and the resistive devices 102 that are connected to one another in a series manner and using the slew-rate enhancement circuits 111, the negative effect on the transient response time of the light-emitting diode driver 1 due to the parasitic capacitance in each of the current control circuits 110 can be reduced.

That is to say, the light-emitting diode driver 1 can have a higher transient response speed. Accordingly, during a turned-on period, the current value of the driving current outputted to each of the light-emitting diodes 2 can be rapidly increased to a preset current value. In this way, the color accuracy and the color resolution of the display apparatus M1 in the embodiment of the present disclosure can be improved. Furthermore, the display apparatus M1 in the embodiment of the present disclosure can also have a larger color gamut.

Beneficial Effects of the Embodiments

In conclusion, in the light-emitting diode driver and the display apparatus using the same provided by the present disclosure, by virtue of any two of the bias circuits 101 being electrically coupled to each other through at least one of the resistive devices 102, and the slew-rate enhancement circuit 111 being electrically coupled to the current control circuit 110 to output the complementary current, the light-emitting diode driver 1 has a fast transient response.

Specifically, the bias circuits 101 and the resistive devices 102 jointly form the resistive bias network, such that the bias currents outputted by the different bias circuits 101 can compensate each other, and the negative effect on the transient response time of the light-emitting diode driver 1 due to the parasitic capacitance of the transistors 110T can be reduced.

Furthermore, in the light-emitting diode driver 1 of the embodiment of the present disclosure, by using the slew-rate enhancement circuit 111 for outputting the complementary current to the current control circuit 110 that is electrically connected thereto, a period for the current value of the driving current to be increased to a preset current value can be shortened. However, a standby current or static power consumption of the light-emitting diode driver 1 is not significantly increased. When the light-emitting diode driver 1 is implemented in the display apparatus M1, the color accuracy and the color resolution of the display apparatus M1 can be improved. Additionally, the display apparatus M1 in the embodiment of the present disclosure can have a larger color gamut.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A light-emitting diode driver, comprising:

a driving module including a plurality of bias circuits and a plurality of resistive devices, wherein any two of the bias circuits are electrically coupled to each other through at least one of the resistive devices; and a plurality of current control modules respectively coupled to the bias circuits, wherein each of the current control modules includes:

a current control circuit configured to output a driving current; and a slew-rate enhancement circuit electrically coupled to the current control circuit to output a complementary current.

2. The light-emitting diode driver according to claim 1, wherein the current control circuit includes a plurality of transistors, and gate terminals of the transistors are jointly coupled to the slew-rate enhancement circuit.

3. The light-emitting diode driver according to claim 1, wherein the current control circuit includes at least one transistor, and the slew-rate enhancement circuit includes a slew-rate enhancement transistor that has a control gate terminal, a first terminal, and a second terminal; wherein a gate terminal of the at least one transistor and the first terminal of the slew-rate enhancement transistor are jointly coupled to a control node.

4. The light-emitting diode driver according to claim 3, wherein the slew-rate enhancement circuit further includes a voltage setting circuit that is coupled to the control gate terminal of the slew-rate enhancement transistor, so that a preset bias is applied to the control gate terminal of the slew-rate enhancement transistor.

5. The light-emitting diode driver according to claim 4, wherein the voltage setting circuit includes a first transistor and a second transistor, a first source terminal of the first transistor is electrically coupled to a second drain terminal of the second transistor, and a first drain terminal of the first transistor and the control gate terminal of the slew-rate enhancement transistor are jointly coupled to a current source.

6. The light-emitting diode driver according to claim 3, wherein the second terminal of the slew-rate enhancement transistor is coupled to a power supply terminal.

7. The light-emitting diode driver according to claim 1, wherein each of the bias circuits includes an output node, and each of the resistive devices is connected between the two output nodes of any two of the bias circuits.

8. The light-emitting diode driver according to claim 7, wherein the current control circuit includes at least one transistor, and a gate terminal of the at least one transistor is coupled to a control node; wherein each of the current control modules includes a first switch device that is connected between the control node and the output node.

9. The light-emitting diode driver according to claim 1, wherein the driving module further includes a reference voltage circuit electrically coupled to each of the bias circuits.

10. The light-emitting diode driver according to claim 1, wherein one of the resistive devices is coupled in series between every two of the bias circuits, so as to form a resistive bias network.

11. The light-emitting diode driver according to claim 1, wherein a quantity of the resistive devices is equal to or greater than a quantity of the bias circuits.

12. The light-emitting diode driver according to claim 1, wherein a ratio of a quantity of the bias circuits to a quantity of the current control modules is greater than 0.5.

13. A display apparatus, comprising:

a pixel array including a plurality of pixels, wherein each of the pixels includes a plurality of light-emitting diodes for respectively generating different color light beams, so as to output a mixed light beam; and the light-emitting diode driver as claimed in claim 1, wherein the current control modules are respectively and electrically connected to the light-emitting diodes, so as to control a color of the mixed light beam that is emitted from each of the pixels.

14. The display apparatus according to claim 13, wherein in each of the pixels, the light-emitting diodes include a red light-emitting diode, a blue light-emitting diode, and a green light-emitting diode.

15. The display apparatus according to claim 13, wherein the current control circuit includes a plurality of transistors, and gate terminals of the transistors are jointly coupled to the slew-rate enhancement circuit.

16. The display apparatus according to claim 13, wherein the current control circuit includes at least one transistor, the slew-rate enhancement circuit includes a slew-rate enhancement transistor having a control gate terminal, a first terminal, and a second terminal, and a gate terminal of the at least one transistor and the first terminal are jointly coupled to a control node.

17. The display apparatus according to claim 16, wherein the second terminal of the slew-rate enhancement transistor is coupled to a power supply terminal.

18. The display apparatus according to claim 13, wherein each of the bias circuits includes an output node, and each of the resistive devices is connected between the two output nodes of any two of the bias circuits, so as to form a resistive bias network.

19. The display apparatus according to claim 18, wherein the current control circuit includes at least one transistor, and a gate terminal of the at least one transistor is coupled to a control node; wherein each of the current control modules includes a first switch device that is connected between the control node and the output node.

* * * * *